US006918588B2

(12) United States Patent
Müller

(10) Patent No.: US 6,918,588 B2
(45) Date of Patent: Jul. 19, 2005

(54) DEVICE FOR SEPARATING PRINTING PRODUCTS TRANSPORTED IN AN IMBRICATED FORMATION INTO A SUCCESSION OF SPACED PRINTING PRODUCTS

(75) Inventor: Wilfried Müller, Rahden (DE)

(73) Assignee: Kolbus GmbH & Co. KG, Rahden (DE)

( * ) Notice: Subject to any disclaimer, the term of this patent is extended or adjusted under 35 U.S.C. 154(b) by 191 days.

(21) Appl. No.: 10/603,645

(22) Filed: Jun. 25, 2003

(65) Prior Publication Data

US 2005/0061627 A1 Mar. 24, 2005

(30) Foreign Application Priority Data

Jun. 29, 2002 (DE) ..... 102 29 322

(51) Int. Cl.[7] ..... B65G 47/26; B65H 29/00

(52) U.S. Cl. ..... 271/283; 271/197; 198/459.1; 198/461.2; 198/461.3

(58) Field of Search ..... 271/283, 270, 271/196, 197, 202; 198/459.1, 462.2, 461.3, 461.2, 579, 689.1

(56) References Cited

U.S. PATENT DOCUMENTS

| | | | | | |
|---|---|---|---|---|---|
| 4,333,559 | A | * | 6/1982 | Reist | 198/461.3 |
| 4,651,984 | A | * | 3/1987 | Emrich | 271/237 |
| 4,815,581 | A | * | 3/1989 | Deutschlander | 198/461.3 |
| 5,022,644 | A | * | 6/1991 | Burge | 271/270 |
| 5,158,278 | A | * | 10/1992 | Auf der Mauer | 271/270 |
| 5,288,067 | A | * | 2/1994 | Stock | 271/276 |
| 5,626,077 | A | * | 5/1997 | Muller | 101/484 |
| 5,636,833 | A | * | 6/1997 | Maier et al. | 271/276 |
| 5,669,604 | A | * | 9/1997 | Hansen | 271/265.01 |
| 5,810,350 | A | * | 9/1998 | Pollich | 271/276 |
| 5,951,007 | A | * | 9/1999 | Greive et al. | 271/276 |
| 5,996,987 | A | * | 12/1999 | Leu et al. | 271/3.11 |
| 6,000,528 | A | * | 12/1999 | van Maanen | 198/461.1 |
| 6,098,785 | A | * | 8/2000 | Van Maanen | 198/459.8 |
| 6,386,812 | B2 | * | 5/2002 | Garlichs et al. | 412/19 |
| 6,767,013 | B2 | * | 7/2004 | Lehmann | 271/186 |
| 6,845,861 | B2 | * | 1/2005 | Spatafora | 198/471.1 |

FOREIGN PATENT DOCUMENTS

| | | |
|---|---|---|
| DE | 195 46 496 A 1 | 6/1997 |
| DE | 196 25 470 A 1 | 1/1998 |

OTHER PUBLICATIONS

Summary of German Search Report for 102 29 322.8.

* cited by examiner

*Primary Examiner*—Douglas Hess
(74) *Attorney, Agent, or Firm*—Alix, Yale & Ristas, LLP

(57) ABSTRACT

A device for separating an imbricated formation (2) of continuously conveyed printing products (1) into a succession of spaced printing products (1), comprises a first conveyor (3) driven at a first velocity (v1), a second conveyor (4) arranged after the first conveyor (3) and driven at a second velocity (v2) which is higher in relation to the first velocity, and a de-imbricating device (5, 6) for accelerating the leading printing product (1) of the imbricated formation (2) to the second velocity (v2) and for maintaining the imbricated arrangement of the following printing products (1) being conveyed in the imbricated formation (2) at the first velocity (v1). The de-imbricating device comprises two suction belt conveyors (5, 6), the first suction belt conveyor (5) driven at the first velocity (v1), that the second suction belt conveyor (6) is driven at the second velocity (v2). The first suction belt conveyor (5) has a suction field (7) which is displaceable along the feed direction (F) with respect to the format height (H) of the printing products (1) and the second suction belt conveyor (6) has a suction field (8) which is arranged at the start of the suction belt conveyor (6), as seen in the feed direction (F).

15 Claims, 1 Drawing Sheet

DEVICE FOR SEPARATING PRINTING PRODUCTS TRANSPORTED IN AN IMBRICATED FORMATION INTO A SUCCESSION OF SPACED PRINTING PRODUCTS

BACKGROUND OF THE INVENTION

The present invention relates to a device for separating an imbricated formation of printing products such as periodicals, brochures and the like which are continuously conveyed in a partially overlapping, imbricated manner, into a succession of spaced printing products.

In the manufacture of adhesive-bound printing products (brochures) it is necessary to dry these printing products between the adhesive binder and the following processing station, e.g. the three-side trimmer. This generally takes place using a relatively long conveyor track to which the printing products are transferred after the adhesive binder. To achieve short feed distances and low feed velocities the printing products are conveyed on the drying track in a continuous, imbricated formation in which the printing products overlie one another in an imbricated manner through partial overlapping. At the end of the drying track the imbricated formation must be separated into individually-conveyed printing products in order to be fed to the following processing station.

Separating devices are known which comprise a first conveyor driven at the velocity of the drying track and forming in a sense the end of the drying track, a second conveyor arranged after the first and driven at a second velocity which is higher in relation to the velocity of the first conveyor, and a de-imbricating device consisting of two pressure rollers for accelerating the leading printing product of the imbricated formation to the second velocity and for maintaining the imbricated arrangement of the following printing products being conveyed in the imbricated formation at the first velocity, the first pressure roller being arranged at the end of the first conveyor and the second pressure roller acting on the printing products at the start of the second conveyor. The effectiveness of the separating device depends on a large number of parameters which must be mutually adjusted. The parameters determined by the printing products are, for example, their size, which is defined by a width, a height and a thickness, their surface quality and their weight. Changeable parameters are, for example, the feed velocities, which determine the degree of imbrication as a measure of the mutual overlap of the printing products and the distance between the conveyed printing products after separation, the surface quality of the conveyor belts and of the pressure rollers, the position of the pressure rollers on the conveyors, and their application pressure, geometrical form and size, among other parameters.

The separation of flat printing products only a few millimetres thick and with low adhesion between their surfaces generally does not present a problem. With thicknesses of 4 mm and above, however, more complex adjustments are required. The reason is that the forces exerted by the pressure rollers are transmitted to the printing products as downwardly-widening cones of force, which are generated in particular by the increased inherent stiffness of the printing products along the bound side and are increased by mutually adhering surfaces. As a result, the leading printing product in the imbricated formation is still being held on the first conveyor while the second pressure roller is acting on this printing product to accelerate same. This gives rise to undefined removal processes which manifest themselves in skewed positioning and uneven spacing of the individually conveyed printing products. Simultaneous removal or entrainment of two or more printing products may also occur which are then transported further while retaining their imbricated arrangement. In the case of relatively thick printing products the first pressure roller literally jumps over the upwardly projecting edges of the imbricated formation, giving rise to irregular, practically oscillating pressure relationships. Although this can be countered by increasing the pressure of the rollers, the printing products are thereby deformed to become a dished, imbricated formation which is therefore difficult to separate.

SUMMARY OF THE INVENTION

It is the object of the present invention to provide a device for separating an imbricated formation of printing products such as periodicals, brochures and the like which are continuously conveyed in a partially overlapping, imbricated manner, into a succession of spaced printing products, which device makes possible reliable and trouble-free separation of the imbricated formation at high processing speed and without complex adjustment measures, while being of simple construction.

The inventive concept lies in generating the forces for retaining the printing products on the conveyor belts, for accelerating the leading printing product and for maintaining the imbricated arrangement of the following printing products conveyed in the imbricated formation, by means of a suction effect incorporated in the conveyor belts and acting on the printing products from below, and in dispensing with pressure rollers or the like acting on the printing products from above. The suction effect, which is geometrically defined by the suction fields in the suction belt conveyors is arranged, in the first suction belt conveyor, to be adjustable along the feed direction in relation to the format height of the printing products. This ensures that the suction effect of the conveyor belt ends when the printing product to be separated enters the range of action of the suction field arranged at the start of the second suction belt conveyor, whereby clearly-defined removal conditions are provided. The arrangement is usable both for an overlying and for an underlying arrangement of the following printing product in the imbricated formation. By dispensing with the pressure rollers arranged above the printing products, optimum access to the printing products in the separating area is made possible.

It has proved advantageous to restrict the suction effect of the first suction belt conveyor to the first printing product following the printing product to be separated. To achieve this, the length of the suction field is made adjustable. In a preferred embodiment the apertures in the conveyor belts of the suction belt conveyor are distributed evenly over the continuous length of the conveyor belt and are arranged in a section of the width of said belt positioned approximately at its centre. To enlarge the suction area the apertures in the conveyor belts are widened to form pockets on the side of the belt supporting the printing products. The continuous supply of a partial vacuum to the suction fields, which partial vaccum can preferably be generated by a side channel compressor, the intake of which is connected to the suction fields, is advantageous. An especially low-cost device results from the above-mentioned features.

To attach by suction especially stiff printing products the suction field of the first suction belt conveyor is displaceably positionable transversely to the feed direction, the whole suction belt conveyor being displaced in a simple manner. The stiffness of the printing products is based primarily on the spine binding disposed on one of the longitudinal sides of the printing products. On the other side the printing products are still entirely flexible and can be drawn against the conveyor belt by specified placing of the suction field. Because of the greater stiffness of the printing products on the spine binding side, it is appropriate to position the suction field of the second suction belt conveyor on this side, which can be simply achieved by displacing the second suction belt conveyor transversely with respect to the feed direction. To align the imbricated formation fed by the first conveyor and to align the separated printing products, the suction belt conveyors are preferably equipped with lateral guide rails.

BRIEF DESCRIPTION OF THE DRAWINGS

The invention will now be exemplified with reference to an embodiment illustrated in the drawings, in which.

DESCRIPTION OF THE PREFERRED EMBODIMENT

Figure 1:
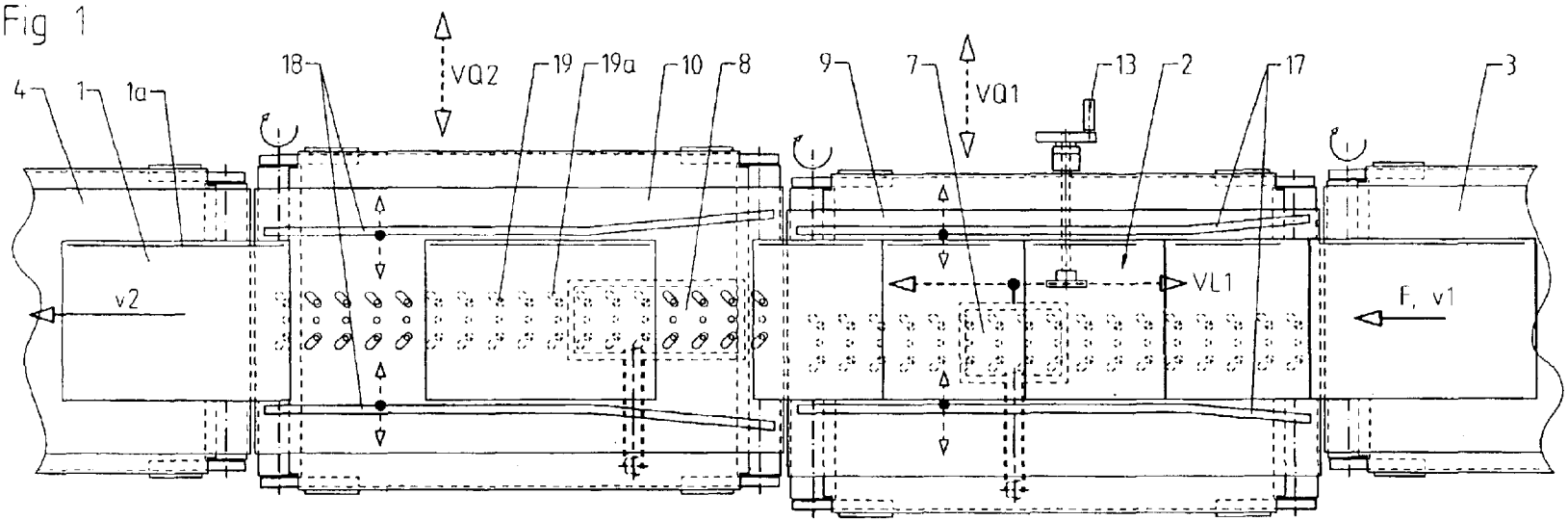
FIG. 1 shows the device according to the invention in plan view.
Figure 2:
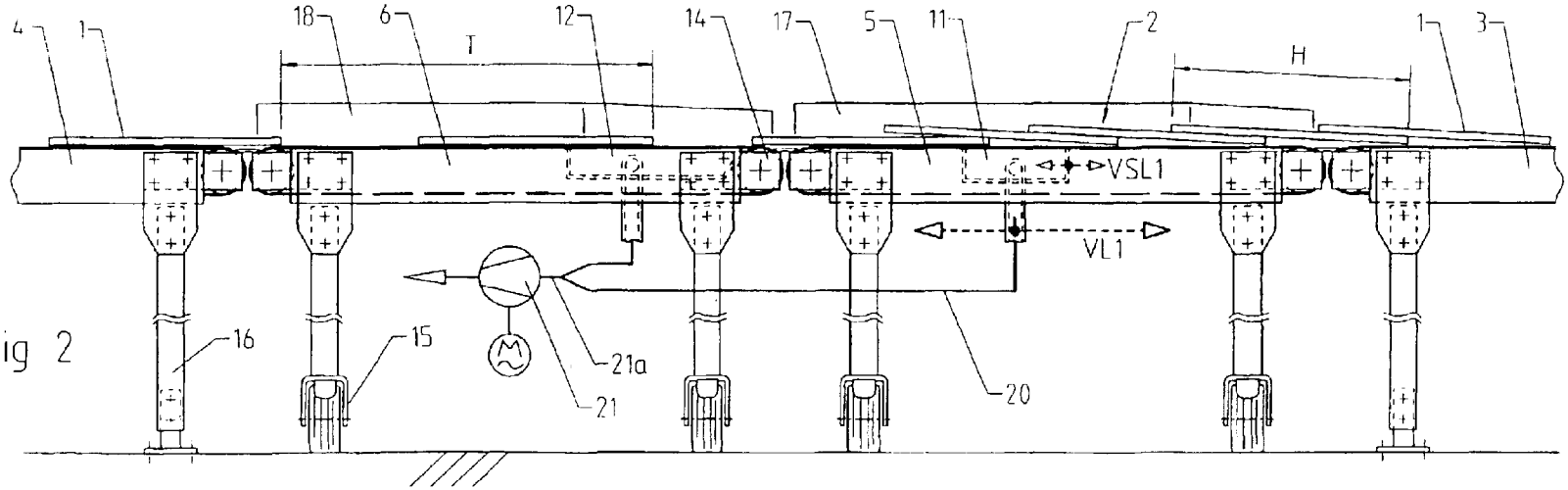
FIG. 2 shows a side view of the device.

The device consists essentially of two suction belt conveyors 5 and 6 which are arranged one behind the other between a first conveyor 3 feeding the printing products 1 in an imbricated formation 2 and a second conveyor 4 transporting further the separated and spaced printing products 1. The printing products 1 are transported through the device in the feed direction F, the imbricated formation 2 being conveyed at a feed velocity v1 and the separated printing products 1 being transported further at a feed velocity v2 which is higher in relation to the first feed velocity v1.

In the imbricated formation 2 the printing products 1 lie in an imbricated manner one above the other, overlapping with a part of their longitudinal extension of format height H; the following printing product 1 can lie above or below the preceding product. In the embodiment shown, an overlying imbricated formation 2 having an overlap of approximately 40% is illustrated.

As a special feature in comparison to normal conveyors such as 3 and 4, the suction belt conveyors 5, 6 are characterised by conveyor belts 9, 10 provided with apertures 19. The apertures are distributed evenly over the length of the conveyor belts 9, 10 and approximately centrally with respect to the width of the belts. During the continuous circulation of the conveyor belts 9, 10 the apertures reach the range of action of suction boxes 11 and 12 to which a partial vacuum can be applied; the suction boxes 11 and 12 are arranged within the suction belt conveyors 5 and 6 and above them suction fields 7 and 8 are formed on the carrier side of the conveyor belts 9, 10. As they pass over the suction fields 7, 8, the transported printing products 1 are attached by suction, whereby it is ensured that the printing products 1 are transported at the velocity predefined by the suction belt conveyors 5, 6, i.e. at the first feed velocity v1 on the first suction belt conveyor 5 and at the second feed velocity v2 on the second suction belt conveyor 6.

The partial vacuum in the suction boxes 11, 12 is generated by a side channel compressor 21 to the intake 21*a* of which the suction boxes 11, 12 are connected via supply lines 20. Switching off and on of the partial vacuum synchronously with the printing products 1 to be separated is not provided. To enlarge the suction area and therefore to improve the suction effect, the apertures 19 in the conveyor belts 9 and 10 are widened to form pockets 19*a* on the side supporting the printing products 1.

The suction field 8 is located at the start of the suction belt conveyor 6, seen in the feed direction F. The suction field 8 should act as early as possible on the leading surface of the leading product as it emerges from suction conveyor 5 and extends past the belt deflector of the second suction conveyor 6. The second suction field is arranged directly after the belt deflector 14 of the second suction conveyor 6, as seen in the feed direction. As soon as a printing product 1 comes within the range of action of this suction field 8 it is accelerated to the feed velocity v2 of the suction belt conveyor 6 and is withdrawn from the imbricated formation 2, while the following printing product 1 is retained on the conveyor belt 9 of the first suction belt conveyor 5 by the suction area 7. The suction field 7 is arranged to be displaceable with respect to the format height H along the feed direction F, in such a way that the printing product 1 grasped by the suction field 8 is no longer within the range of action of the suction field 7. Clearly-defined withdrawal conditions are obtained for the leading printing product 1 of the imbricated formation 2, while the following printing products 1 remain in their ordered imbricated formation. The displaceable arrangement of the suction field 7 is represented symbolically in the Figures by the displacement VL1. It can be executed from outside via a handwheel 13. Also provided is a displacement VSL1, whereby the length of the suction field 7 is variable.

Whereas the conveyors 3 and 4 are arranged statically with feet 16 fixed to the floor, the suction belt conveyors 5 and 6 are displaceable transversely to the feed direction F by means of fully lockable frame rollers 15. The possibility of lateral displacement is indicated in FIG. 1 by the double arrows drawn with broken lines and by the designations VQ1 and VQ2. The lateral displacement VQ1 makes it possible to position the suction field 7 of the first suction belt conveyor 5 in the area of the printing products 1 where their stiffness is lowest and where the printing products 1 can be sucked against the conveyor belt 9 more simply. In the case of adhesive-bound printing products 1 this area is on the side opposite the spine binding 1*a*. By contrast, the lateral displacement VQ2 moves the suction field 8 of the suction belt conveyor 6 to the area where the printing products 1 have high stiffness.

The suction belt conveyors 5, 6 are equipped with lateral guide rails 17, 18 which are adjustable to the format width, for aligning the imbricated formation 2 fed by the first conveyor 3 before separation, and for aligning the separated printing products 1 which are transferred at an approximately constant reciprocal cycling distance T to the conveyor 4.

What is claimed is:

1. A device for separating an imbricated formation of printing products having a format height (H) continuously conveyed in a feed direction (F) while partially overlapping in an imbricated manner, into a succession of spaced printing products, comprising:

a first conveyor for said imbricated formation driven at a first velocity (v1);

a second conveyor for said spaced products arranged after said first conveyor and driven at a second velocity (v2) which is higher in relation to the first velocity; and a de-imbricating device for accelerating the leading printing product of the imbricated formation of the first conveyor to the second velocity (v2) and for maintaining the imbricated arrangement of the following printing products being conveyed in the imbricated formation at the first velocity (v1);

wherein the de-imbricating device includes two suction belt conveyors with associated belt deflectors, arranged one behind the other between the first and second conveyors, the first suction belt conveyor driven at the first velocity (v1), the second suction belt conveyor driven at the second velocity (v2);

the first suction belt conveyor having a suction field which is displaceable along the feed direction (F) with respect to the format height (H) of the printing products; and the second suction belt conveyor having a suction field which is arranged at the start of the second suction belt conveyor directly after the belt deflector of the second suction conveyor, as seen in the feed direction (F).

2. Device according to claim 1, wherein the suction field of the first suction belt conveyor has a length that is adjustable along the feed direction (F).

3. Device according to claim 2, wherein the conveyor belts of the suction belt conveyors are provided with apertures distributed evenly over the full length of the conveyor belts and substantially centrally of the width of the belts.

4. Device according to claim 3, wherein the apertures in the conveyor belts widen toward the outside of the belt to form pockets to enlarge the suction area acting on the printing product.

5. Device according to claim 2, wherein the first suction belt conveyor is adjustably positionable transversely to the feed direction (F), relative to the first conveyor.

6. Device according to claim 5, wherein the second suction belt conveyor is adjustably positionable transversely to the feed direction (F), relative to the first section belt conveyor.

7. Device according to claim 1, wherein the conveyor belts of the suction belt conveyors are provided with apertures distributed evenly over the full length of the conveyor belts and substantially centrally of the width of the belts.

8. Device according to claim 7, wherein the apertures in the conveyor belts widen toward the side of the belt that faces the printing product to form pockets to enlarge the suction area acting on the printing product.

9. Device according to claim 7, including means for supplying the suction fields of the suction belt conveyors continuously with a partial vacuum while separating the printing products.

10. Device according to claim 9, wherein the means for supplying a partial vacuum comprises a side channel compressor having an intake that is fluidly connected to the suction fields.

11. Device according to claim 1, including means for supplying the suction fields of the suction belt conveyors continuously with a partial vacuum while separating the printing products.

12. Device according to claim 11, wherein the means for supplying a partial vacuum comprises a side channel compressor having an intake that is fluidly connected to the suction fields.

13. Device according to claim 1, wherein the first suction belt conveyor is adjustably positionable transversely to the feed direction (F), relative to the first conveyor.

14. Device according to claim 1, wherein the second suction belt conveyor is adjustably positionable transversely to the feed direction (F), relative to the first suction belt conveyor.

15. Device according to claim 1, wherein the suction belt conveyors are equipped with lateral guide rails for aligning the imbricated formation fed by the first conveyor and for aligning the separated printing products.

* * * * *